United States Patent [19]

Piazza et al.

[11] Patent Number: 4,575,349

[45] Date of Patent: Mar. 11, 1986

[54] WINGED CREATURE

[75] Inventors: Pietro Piazza, Prospect; Richard I. Farrington, New Britain, both of Conn.

[73] Assignee: Coleco Industries, Inc., West Hartford, Conn.

[21] Appl. No.: 700,505

[22] Filed: Feb. 11, 1985

[51] Int. Cl.[4] ..... A63H 3/20

[52] U.S. Cl. ..... 446/330

[58] Field of Search ..... 446/330, 268, 35, 340, 446/230, 352

[56] References Cited

U.S. PATENT DOCUMENTS 2,036,328 4/1936 Furey .
2,548,237 4/1951 Pearson ..... 446/340
2,637,939 5/1953 Polk .
3,053,008 9/1962 Pelunis ..... 446/330
3,153,871 10/1964 Semba .
3,577,670 5/1971 Gutierrez .
4,244,138 1/1981 Holahan et al. .
4,307,533 12/1981 Sims et al. .

*Primary Examiner*—Mickey Yu

[57] ABSTRACT

A winged creature employs a push-button member that is reciprocated to simulate a flapping action of wing elements, which can be provided by a one-piece member rigidly affixed to the push-button member. The wing elements are constructed for pivotable movement, and the edges of the push-button member traversed thereby will advantageously be configured to provide a smooth transition, so as to facilitate such movement.

11 Claims, 4 Drawing Figures

WINGED CREATURE

BACKGROUND OF THE INVENTION

Toys capable of animation have long found widespread appeal among children, and are disclosed in numerous forms in the prior art. One form of such action toys simulates a creature having wings that are movable in a flapping action, as disclosed in the following U.S. Pat. Nos. 2,036,328 to Furey; 2,637,939 to Polk; 3,153,871 to Semba; 3,577,670 to Gutierrez; 4,244,138 to Holahan et al; and 4,307,533 to Sims et al.

More particularly, the Furey patent describes a toy insect having movable wings that are operatively connected to a pair of ground-engaging wheels.

A flapping wing toy, constructed to simulate a bird or butterfly, is shown in the Polk patent; it employs a pair of hinged arms, oscillated by finger pressure, to which the wing sections are attached.

Semba shows the use of an electric motor to animate various parts of a bird toy, including the wings; projections on a rotated disc successively engage a rod to which the wings are attached, oscillating the rod and thereby causing a fluttering effect of the wings.

Gutierrez discloses a wing flapping toy in which the wings are loosely mounted upon a handle, and are held in place by a rubber band. The handle has a spring-like portion which terminates in a pair of parallel ears, disposed to force the wings to elevated positions when the handle is squeezed.

The Holahan et al patent describes an animated bird toy in which a trigger-like lever, pivotably mounted upon the body, is operated to simulate flapping of outwardly extending portions of the wings.

In the toy insect of the Sims et al patent, four wings are rotatably mounted upon pins attached to hinged mounting plates. The plates are acted upon by a lever to elevate the wings against the force of gravity.

It is of course desirable to achieve optimal visual appeal, functional effectiveness, and durability in any such toy, while minimizing the complexity of the animating mechanism and the cost of manufacture. Despite the level of prior art activity indicated above, a demand remains for toys of unique construction, in which the foregoing criteria are realized.

Accordingly, it is a broad object of the present invention to provide a novel toy creature having manually actuated flappable wings, in which the operating mechanism is of relatively uncomplicated and durable construction, and is easy and effective to use.

It is also an object of the invention to provide such a toy creature which is economical to manufacture, and in which the parts employed for the actuating mechanism are relatively simple and few in number.

A more specific object of the invention is to provide, as an animated toy, a winged creature in which the wing elements may be provided by a single, integrally formed piece.

SUMMARY OF THE INVENTION

It has now been found that the foregoing and related objects of the invention are attained by the provision of a toy creature comprised of a body, having an internal cavity with a pair of lateral openings communicating therewith and formed in opposite sides thereof, and an actuating member generally having an upwardly extending button portion thereon. Means is provided for mounting the actuating or push-button member substantially within the cavity of the body for pivotable movement about a transverse axis between the opposite sides, with the button portion thereof accessible for finger-actuating contact, and means is also provided for upwardly biasing the push-button member. A pair of wing elements are rigidly affixed on a supporting portion of the actuating member, and extend in generally opposite directions and outwardly through the lateral body openings, with at least the portions of the wing elements adjacent the supporting portion being adapted for pivotable movement thereabout. When the actuating member is depressed against the force of the biasing means, the underlying marginal portions of the body, defining the lateral openings thereof, cooperate therewith to deflect the wing elements upwardly, enabling a flapping action of the wing elements to be simulated by reciprocation of the actuating member.

The body of the creature will generally have an upper wall portion in which is formed an opening through which the button portion of a push-button form of actuating member will normally protrude for external contact. Preferably, the wing elements will be affixed against the bottom surface of the supporting portion and will traverse laterally spaced edge elements thereof, the latter being configured to provide relatively smooth transition surfaces, extending upwardly from the bottom surface, to facilitate pivoting of the wing elements thereabout. Usually, the bottom surface of the supporting portion will be substantially planar; the transition surfaces will generally be contiguous thereto, and will advantageously be provided by chamfers extending longitudinally along the lower lateral edges thereof.

In particularly preferred embodiments the wing elements will be provided by a one-piece wing member, integrally formed from a semi-rigid material having sufficient inherent flexibility to permit the necessary pivoting movement, and including a connecting web element between the wing elements by which it is affixed to the actuating member. A retainer may be engaged with the actuating member to affix the wing member to it, the retainer desirably having a platform portion providing underlying support for the wing member and clamping the connecting web element against the supporting portion; engagement with the actuating member may be achieved by the provision of a stud portion on the retainer which extends through the connecting web element of the wing member.

In most instances, the wing elements will be relatively thin and wide and of generally planar configuration, with the lateral openings in the body being in the form of slots extending longitudinally along sidewall portions thereof. The biasing means employed will usually be a coil spring disposed beneath the button portion of the push-button member, acting thereagainst and against an underlying wall portion of the body.

DETAILED DESCRIPTION OF THE ILLUSTRATED EMBODIMENT

Figure 1:
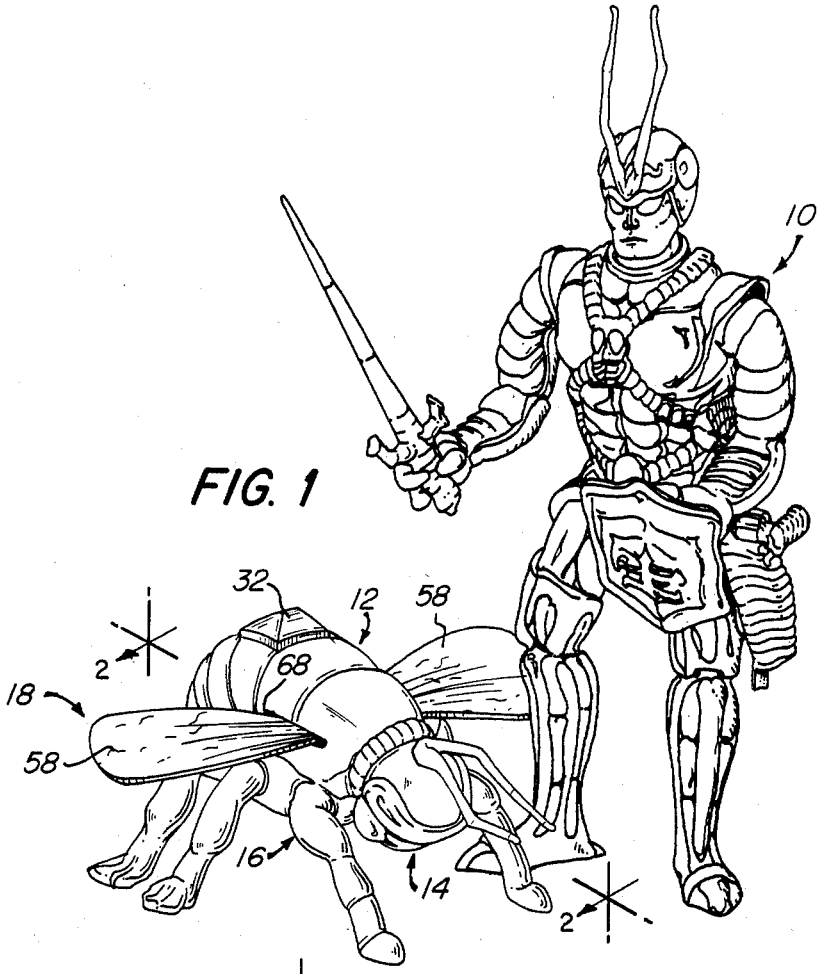
FIG. 1 is a perspective view of a winged creature toy embodying the present invention, accompanied by a humanoid figure.

Although the winged creature of the invention may take diverse forms, a science-fiction motif is currently regarded to be among the most desirable. Accordingly, FIG. 1 depicts the creature as companion to a humanoid figure, generally designated by the numeral 10; the humanoid is depicted, however, solely to illustrate the thematic concept, and constitutes no part of the present invention.

The winged creature consists of upper and lower hollow body parts, generally designated by the numerals 12, 14, respectively, a hexapodal base member, generally designated by the numeral 16, and a wing member generally designated by the numeral 18. The upper and lower body portions 12, 14 cooperatively define an internal cavity or chamber 20, and antenna-like structure 21 is affixed to the head section 23, solely for purposes of appearance. The upper body part 12 has a pair of depending cylindrical bosses 22 formed into its underside, which receive and engage the corresponding upstanding pins 24 of the lower body half 14 to hold the parts in assembly. The base member 16 is secured to the lower body part 14 by a suitable fastener 26, which passes upwardly therethrough and is engaged within the cylindrical boss 28.

Disposed within the cavity 20 of the creature body is a one-piece, push-button type of actuating member, or trigger, generally designated by the numeral 30, which has an elevated button portion 32 normally protruding partially through the rectangular opening 34 formed in the upper body part 12. An axle portion 36 is formed at the rearward end of the push-button member 30, and provides stub axial elements 36' at its outer ends. The elements 36' are supported upon the short upstanding ribs 38, and are journaled within semi-circular recesses formed into the ends of the cooperating ribs 40 depending from the upper body section 12, to pivotably mount the member 30 for reciprocation inwardly and outwardly of the creature body (as indicated by the arrows in FIGS. 2 and 3). It is urged to its normal, outward or elevated position by the coil spring 42, which bears upon the underside of the button portion 32 and the lower body section 14, the latter having a short upstanding post 44 formed thereon for maintaining the spring 42 in proper position.

A platform portion 46, having a planar lower surface 52, is provided at the forward end of the push-button member 30; longitudinally spaced, depending flange elements 50 extend across the platform portion along the forward and rearward margins of the surface 52, and an aperture 48 is formed centrally thereof. The platform portion 46 is relieved along its lower lateral edges by longitudinally extending chamfers 54, contiguous to the planar surface 52.

Figure 2:
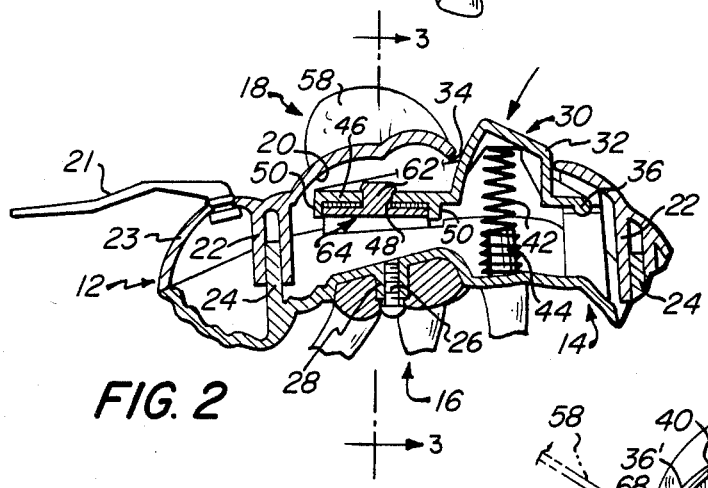
FIG. 2 is a fragmentary sectional view of the winged toy, taken along line 2—2 of FIG. 1.
Figure 4:
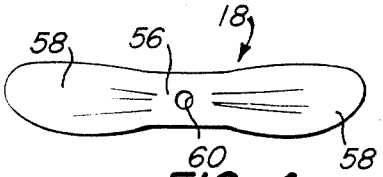
FIG. 4 is a plan view of the wing member utilized in the toy creature assembly.
Figure 3:
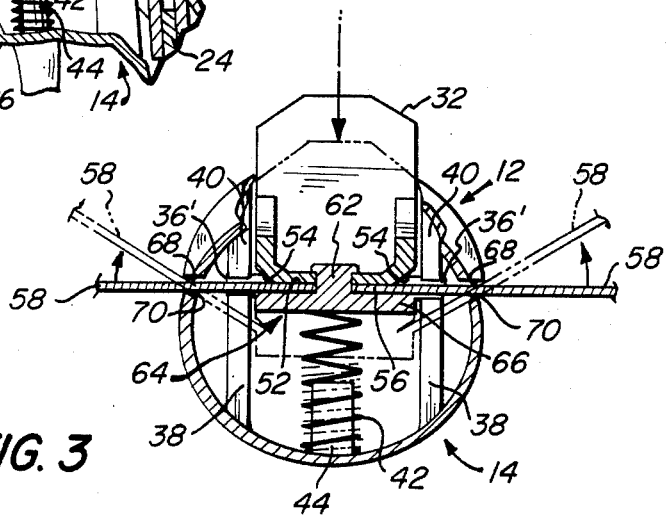
FIG. 3 is a fragmentary sectional view of the toy, taken along line 3—3 of FIG. 2 and drawn to an enlarged scale, showing the resting and actuated positions of the push-button member and wing elements, in full and phantom line respectively.

The wing member 18 is positioned to extend across the platform portion 46; it has a web element 56, connecting the outer wing elements 58, dimensioned to seat between the flange elements 50. The wing member also has a central aperture 60, through which is received the short stud 62 of a retainer, generally designated by the numeral 64. As can be seen in FIGS. 2 and 3, the retainer 64 is secured to the platform portion 46 of the push-button member 30 by insertion of the stud 62 through the aperture 48, with the enlarged tip thereof establishing a snap-fit interengagement. The connecting web element 56 of the wing member 18 is clamped against the lower surface 52 of the platform portion by the enlarged, generally rectangular base portion 66 of the retainer, which provides underlying support for the wing elements 58.

The wing elements extend laterally through the slot-like openings 68 formed in the opposite sides of the upper body section 12. Depressing the button portion 32 causes the wing elements to contact the bevelled lower edges 70 defining the openings 68, and thereby deflects them upwardly. In doing so, the wing member 18 pivots about the longitudinally extending bevelled surfaces defined by the chamfers 54; the reduction in angularity provided results in a smoother transition (as compared, for example, to a right-angle bend at the full width of the platform), thereby facilitating the necessary pivoting and causing the wing member to be subjected to reduced levels of stress and wear. Ultimately, the wing elements 58 will reach the positions shown in phantom line in FIG. 3, lying within the edge chamfers 54 on the platform portion 46 and in full surface contact with the bevelled edges 70 of the openings 68. As will be appreciated, release of force upon the button portion 32 will permit the coil spring 40 to return the member 30 to its fully elevated position, causing the wing elements 58 to resume their normal, lower positions; reciprocation will simulate a flapping wing motion.

Although various materials of construction can be employed for the several parts of the toy, as will be evident to those skilled in the art, most of them will desirably be made of molded plastics. For example, the body sections and the push-button member may be of an acrylonitrile/butadiene/styrene type of synthetic resinous material, and the leg-simulating base member may be of a rigid polyvinyl chloride. The wings will also normally be fabricated from a synthetic resinous material, which may be in the form of a laminated sheet (typically about ten mils in thickness) of acetate or vinyl plastic, preferably constructed or treated to provide an iridescent or similar optical effect. A material particularly preferred for use in fabricating the wing of the creature is the proprietary PVC laminate commerially available from the Coburn Corporation, of Lakewood, N.J. under the trade designation DEFRACTO-LIGHT.

Thus, it can be seen that the present invention provides a novel toy creature having manually actuated flappable wings, in which the operating mechanism is of relatively uncomplicated and durable construction, and is easy and effective to use. More particularly, the invention provides an animated winged creature that is relatively economical to manufacture, in which the wing elements may be provided as a single, integrally formed piece, the latter being mounted to hinge freely and under relatively low levels of stress.

Having thus described the invention, what is claimed is:

1. In a toy creature having manually actuated flappable wings, the combination comprising: a creature body having an internal cavity and a pair of lateral openings communicating therewith and formed in opposite sides of said body; a manual actuating member having a wing supporting portion thereon with a bottom surface; means for mounting said actuating member substantially within said body cavity for pivotable movement about a transverse axis between said opposite sides, and for actuation by the application of manual force externally applied thereto; means for upwardly biasing said actuating member; and a pair of wing elements rigidly affixed to said bottom surface of said supporting portion of said actuating member and extending in generally opposite directions therefrom outwardly through said lateral body openings, at least the portions of said wing elements adjacent said supporting portion being adapted for pivotable movement thereabout, said actuating member and the underlying marginal portions of said body defining said lateral openings cooperating to deflect said wing elements upwardly when said actuating member is depressed against the force of said biasing means, said supporting portion having laterally spaced edge elements transversed thereby, said edge elements being configured to provide relatively smooth transition surfaces extending upwardly from said bottom surface to facilitate pivoting of said wing elements thereabout, said wing elements being provided by a one-piece wing member integrally formed from a semi-rigid material having sufficient inherent flexibility to permit such pivoting movement thereof, said wing member having a connecting web element between said wing elements by which it is affixed to said supporting portion of said actuating member, thereby enabling a flapping action of said wing elements to be simulated by reciprocation of said actuating member.

2. The combination of claim 1 wherein said actuating member is a push-button member having an upwardly extending button portion thereon, and wherein said body has an upper wall portion with an opening formed therethrough in communication with said cavity, said button portion of said push-button member normally protruding through said upper wall portion opening to permit the external application of force thereto.

3. The combination of claim 1 wherein said bottom surface of said supporting portion is substantially planar and said transition surfaces are contiguous thereto, said transition surfaces being provided by chamfers extending longitudinally along the lower lateral edges of said supporting portion.

4. The combination of claim 2 wherein said supporting portion of said push-button member is spaced longitudinally from said mounting means with said button portion disposed therebetween.

5. The combination of claim 1 wherein said material is a sheet of synthetic resinous material.

6. The combination of claim 1 additionally including a retainer engaged with said actuating member and affixing said wing member thereto, said retainer having a platform portion providing underlying support for said wing member and clamping said connecting web element thereof against said supporting portion.

7. The combination of claim 6 wherein said retainer has a stud portion extending through said connecting web element and engaged by said push-button member.

8. The combination of claim 1 wherein said wing elements are relatively thin and wide and of generally planar configuration, and wherein said lateral openings are slots extending longitudinally along sidewall portions of said body.

9. The combination of claim 2 wherein said push-button member is integrally formed, as a single piece, from a synthetic resinous material.

10. The combination of claim 2 wherein said biasing means is a coil spring disposed beneath said button portion of said push button member to act thereagainst and against an underlying wall portion of said body.

11. In a toy creature having manually actuated flappable wings, the combination comprising: a creature body having an internal cavity and a pair of lateral openings and a top opening communicating therewith and formed in opposite sides and the top of said body, respectively; a push-button member having an upwardly extending button portion and a wing supporting portion thereon with a bottom surface; means for mounting said push-button member substantially within said body cavity for pivotable movement about a transverse axis between said opposite sides, with said button portion normally protruding through said top opening for finger-actuating contact; means for upwardly biasing said push-button member; and a pair of wing elements provided by a one-piece wing member rigidly affixed against the bottom surface of said supporting portion of said push-button member and extending in generally opposite directions outwardly through said lateral body openings, said supporting portion having laterally spaced edge elements, transversed by said wing elements and configured to provide relatively smooth transition surfaces extending upwardly from said bottom surface to facilitate pivoting thereabout, and at least the portions of said wing elements adjacent said supporting portion being adapted for such pivoting movement, said push-button member and the underlying marginal portions of said body defining said lateral openings cooperating to deflect said wing elements upwardly when said push-button member is depressed against the force of said biasing means, thereby enabling a flapping action of said wing elements to be simulated by reciprocation of said push-button member.

* * * * *